US008440308B2

(12) United States Patent
Harano et al.

(10) Patent No.: US 8,440,308 B2
(45) Date of Patent: May 14, 2013

(54) METHOD OF MANUFACTURING SHOES AND SHOES

(75) Inventors: Kenichi Harano, Kobe (JP); Tatsuya Amano, Noda (JP); Hisao Matsumiya, Noda (JP)

(73) Assignee: Asics Corporation, Kobe-shi (JP)

( * ) Notice: Subject to any disclaimer, the term of this patent is extended or adjusted under 35 U.S.C. 154(b) by 477 days.

(21) Appl. No.: 12/521,840

(22) PCT Filed: Jan. 29, 2008

(86) PCT No.: PCT/JP2008/051246

§ 371 (c)(1),
(2), (4) Date: Jun. 30, 2009

(87) PCT Pub. No.: WO2008/093653

PCT Pub. Date: Aug. 7, 2008

(65) Prior Publication Data

US 2010/0040889 A1 Feb. 18, 2010

(30) Foreign Application Priority Data

Jan. 30, 2007 (WO) ..... PCT/JP2007/051452

(51) Int. Cl.
*B32B 27/40* (2006.01)
*B32B 37/04* (2006.01)
*C08J 18/12* (2006.01)

(52) U.S. Cl.
USPC ..... 428/423.1; 156/275.7; 526/935; 528/79

(58) Field of Classification Search ..... 526/935; 528/79; 156/275.7; 428/423.1
See application file for complete search history.

(56) References Cited

U.S. PATENT DOCUMENTS 6,844,073 B1 * 1/2005 Helmeke et al. ..... 428/423.1
7,267,878 B2 * 9/2007 Primke et al. ..... 428/423.1
7,767,293 B2 * 8/2010 Kanagawa et al. ..... 428/318.6
2004/0143034 A1 * 7/2004 Primke et al. ..... 523/176
2005/0181204 A1 * 8/2005 Wang et al. ..... 428/354

FOREIGN PATENT DOCUMENTS

JP 63-189101 A 8/1988
JP 5-214315 A 8/1993
JP 9-316157 A 12/1997
WO WO 2008065920 A1 * 6/2008

OTHER PUBLICATIONS

International Search Report of PCT/JP2008/051246, Mailing Date of Apr. 8, 2008.
Chinese Office Action dated Jan. 31, 2012, issued in corresponding Chinese Patent Application No. 200880003438.8, (Partial translation, 7 pages).
Chinese Office Action dated Oct. 22, 2012, issued in corresponding Chinese Patent Application No. 200880003438.8, with Partial English Translation (13 pages).

* cited by examiner

*Primary Examiner* — Thao T. Tran
(74) *Attorney, Agent, or Firm* — Westerman, Hattori, Daniels & Adrian, LLP

(57) ABSTRACT

The method of manufacturing shoes of the present invention comprises a pre-step of heating a following reactive hot-melt adhesive to melt it and providing the melted adhesive on a joining surface of at least one adherend, an ultraviolet treating step of irradiating the adhesive with ultraviolet light having irradiation energy more than 100 mJ/cm$^2$ and less than 1200 mJ/cm$^2$ to polymerize a polyurethane prepolymer, and a joining step of overlaying a joining surface of another adherend on the adhesive to bond both adherends together.
The reactive hot-melt adhesive contains a polyurethane prepolymer having an (meth)acryloyl group and an isocyanate group at the end of a molecule, and a photopolymerization initiator. The polyurethane prepolymer includes a non-crystalline polyol and a crystalline polyol, wherein the non-crystalline polyol is contained from 20% by mass to 90% by mass with respect to the whole polyols. The viscosity of the reactive hot-melt adhesive at 80° C. is 300 Pa·s or less.
The method of manufacturing shoes of the present invention can simplify a work process and shorten working hours, and it is possible to manufacture shoes having excellent durability.

10 Claims, No Drawings

METHOD OF MANUFACTURING SHOES AND SHOES

TECHNICAL FIELD

The present invention relates to a method of manufacturing shoes, which are obtained by bonding constituent members of shoes together with an adhesive, and shoes.

BACKGROUND ART

Shoes are generally manufactured by bonding a variety of constituent members (parts) together with an adhesive.

Each constituent member of the shoes has various shapes in accordance with the location thereof. Accordingly, joining surfaces of constituent members to be bonded are often not planar. Further, manufactured shoes are used in severe conditions. Therefore, The constituent members of the shoes are bonded together with an adhesive having an excellent adhesive force and water resistance.

Hitherto, a solvent type adhesive or an emulsion type adhesive is used when manufacturing the above shoes. However, when the solvent type adhesive is used, there is a problem that the solvent in the adhesive is volatilized. Further, a step of drying the adhesive is required after applying the adhesive whether the solvent type adhesive or the emulsion type adhesive is used. Furthermore, the adhesive has to be respectively applied to the joining surfaces of two constituent members (hereinafter, constituent members of the shoes, which are bonded together with an adhesive, may be referred to as an "adherend") which are subjects of joining. Therefore, the step of applying the adhesive is required two times in bonding two adherends together. Furthermore, after joining the adherends to each other with the adhesive, both adherends have to be kept in a state of keeping pressure bonding for a long time using an implement for retaining a shape. As described above, if the solvent type adhesive or the emulsion type adhesive is used, there is a problem that a work process gets complex or working hours become longer.

DISCLOSURE OF THE INVENTION

It is an object of the present invention to provide a method of manufacturing shoes, by which it is possible to simplify a work process and shorten working hours and it is possible to manufacture shoes having excellent durability.

The present invention provides a method of manufacturing shoes comprising a pre-step of heating a reactive hot-melt adhesive to melt it and providing the melted adhesive on a joining surface of at least one adherend, an ultraviolet treating step of irradiating the adhesive with ultraviolet light having irradiation energy more than 100 mJ/cm$^2$ and less than 1200 mJ/cm$^2$ to polymerize a polyurethane prepolymer, and a joining step of overlaying a joining surface of another adherend on the adhesive to bond both adherends together.

The reactive hot-melt adhesive contains the polyurethane prepolymer including a non-crystalline polyol and a crystalline polyol and having an (meth)acryloyl group and an isocyanate group at the end of a molecule, and a photopolymerization initiator, and the viscosity of the reactive hot-melt adhesive at 80° C. is 300 Pa·s or less.

Since the above reactive hot-melt adhesive contains the non-crystalline polyol and the crystalline polyol as polyols, it has a long open time (time during which an adhesive can be applied) after ultraviolet irradiation and has excellent initial adhesion strength. Therefore, this reactive hot-melt adhesive can bond the adherends together by being applied to a joining surface of at least one adherend and keeping pressure bonding of the adherends for a short time. The manufacturing method of the present invention does not need the step of drying the adhesive, can simplify an application work and a work of keeping pressure bonding, and can shorten working hours of shoes manufacturing. Further, the aforementioned adhesive exhibits extremely high adhesion strength by moisture-curing. Therefore, in the resulting shoes, the joining surface of the adherend is hardly peeled off and excellent in the water resistance. Here, the above reactive hot-melt adhesive can be applied well to the adherend since its viscosity at 80° C. is 300 Pa·s or less.

As the preferable method of manufacturing shoes of the present invention, the amount of the non-crystalline polyol contained in the polyurethane prepolymer is 20% by mass or more and 90% by mass or less with respect to the whole polyols.

As the preferable method of manufacturing shoes of the present invention, the amount of the crystalline polyol contained in the polyurethane prepolymer is 10% by mass or more and 80% by mass or less with respect to the whole polyols.

As the preferable method of manufacturing shoes of the present invention, a ratio (NCO/OH) of an isocyanate group (NCO) to a hydroxyl group (OH) in the polyurethane prepolymer is more than 1.5 and 3.0 or less.

As the preferable method of manufacturing shoes of the present invention, the non-crystalline polyol has a number average molecular weight (Mn) of 1000 to 10000.

As the preferable method of manufacturing shoes of the present invention, the viscosity of the reactive hot-melt adhesive at 80° C. after the irradiation of ultraviolet light having irradiation energy more than 100 mJ/cm$^2$ and less than 1200 mJ/cm$^2$ is at least three times larger than the viscosity at 80° C. before the irradiation of the ultraviolet light.

As the preferable method of manufacturing shoes of the present invention, a ratio between viscosities (viscosity at 60° C./viscosity at 80° C.) of the reactive hot-melt adhesive after the irradiation of ultraviolet light having irradiation energy more than 100 mJ/cm$^2$ and less than 1200 mJ/cm$^2$ is 2.3 or more.

As the preferable method of manufacturing shoes of the present invention, the polyurethane prepolymer is synthesized from polyisocyanate, polyols containing a non-crystalline polyol and a crystalline polyol, and hydroxyl group-containing (meth)acrylate.

As the preferable method of manufacturing shoes of the present invention, the pre-step is a step of heating the reactive hot-melt adhesive processed into sheet form to melt it and providing the melted sheet-like adhesive on a joining surface of one adherend.

As the preferable method of manufacturing shoes of the present invention, the joining surface of one adherend is planar and the joining surface of another adherend has the irregularities.

Further, the present invention provides shoes, wherein a part or the whole of constituent members of the shoes are bonded together with a reactive hot-melt adhesive containing a polyurethane prepolymer having a (meth)acryloyl group and an isocyanate group at the end of a molecule and including the non-crystalline polyol and the crystalline polyol, and a photopolymerization initiator.

In the shoes of the present invention, the joining surface of the adherend is hardly peeled off and excellent in the water resistance. Accordingly, it is possible to provide shoes exhibiting excellent durability under the common conditions of use of shoes.

BEST MODE FOR CARRYING OUT THE INVENTION

Hereinafter, the present invention is specifically explained.

(About Reactive Hot-Melt Adhesive)

A reactive hot-melt adhesive used in the method of manufacturing shoes of the present invention contains a polyurethane prepolymer including a non-crystalline polyol and a crystalline polyol and having an (meth)acryloyl group and an isocyanate group at the end of a molecule, and a photopolymerization initiator. The viscosity of the reactive hot-melt adhesive at 80° C. is 300 Pa·s or less. By heating the adhesive at, for example, 80° C. to melt it and applying to the adherend, and then irradiating the adhesive with ultraviolet light having irradiation energy more than 100 mJ/cm$^2$ and less than 1200 mJ/cm$^2$, this hot-melt adhesive exhibits preferable initial adhesion strength (490 N/m (about 1 kgf/2 cm) or more). Also, after joining the adherends, the adhesive exhibits adhesion strength durable in use of shoes (7355 N/m (about 15 kgf/2 cm) or more) by moisture-curing.

The reactive hot-melt adhesive, in which a polyurethane prepolymer including the non-crystalline polyol and the crystalline polyol and having an (meth)acryloyl group and an isocyanate group at the end of a molecule, and a photopolymerization initiator are contained, exhibits the viscosity of 300 Pa·s or less at 80° C., so that the hot-melt adhesive is excellent in coating properties in a proper coating temperature (from 80 to 100° C.). Also, the reactive hot-melt adhesive has a relatively long open time after ultraviolet irradiation.

The polyurethane prepolymer having a (meth)acryloyl group and an isocyanate group at the end of a molecule can be obtained, for example, by reacting polyisocyanate (A) with an end of polyol (B) and reacting hydroxyl group-containing (meth)acrylate (C) with a part of the isocyanate group.

As the polyisocyanate (A), it is not limited as far as the polyisocyanate (A) has two or more isocyanate groups in one molecule. As specific example of the polyisocyanate (A), for example, tolylene diisocyanate, hydrogenerated tolylene diisocyanate, diphenylmethane diisocyanate, hydrogenerated diphenylmethane diisocyanate, dicyclohexylmethane diisocyanate, hexamethylene diisocyanate, isophorone diisocyanate, xylylene diisocyanate, paraphenylene diisocyanate, and the other publicly known one may be cited. These polyisocyanates (A) may be used singly or in combination of two or more kinds.

Further, as the polyisocyanate (A), biuret type polyisocyanate obtained by reacting the above polyisocyanate with water, adduct type polyisocyanate obtained by reacting the above polyisocyanate with polyalcohol such as trimethylolpropane and the like, a polymer obtained by isocyanurating the above polyisocyanate, and other publicly known one may be used. These polyisocyanates (A) may be used singly or in combination of two or more kinds.

As the polyol (B), it is not limited as far as the polyol (B) has two or more hydroxyl groups in one molecule. As specific example of the polyol (B), for example, polyester polyol, polyether polyol, polycarbonate polyol, polyolefin polyol, polybutadiene polyol, polyisoprene polyol, polycaprolactone polyol, and the like may be cited. These polyols (B) may be used singly or in combination of two or more kinds. The polyol (B) contains non-crystalline polyol and crystalline polyol as essential components. Preferably, the polyol (B) in the reactive hot-melt adhesive of the present invention is composed of the non-crystalline polyol and the crystalline polyol. The non-crystalline polyol and the crystalline polyol may be used singly or in combination of two or more kinds.

Further, the number average molecular weight (Mn) of the non-liquid crystalline polyol is preferably from 1000 to 10000. If the number average molecular weight (Mn) of the non-liquid crystalline polyol is less than 1000, preferable initial adhesion strength may be hardly obtained since initial cohesion strength becomes low. On the other hand, if the number average molecular weight (Mn) of the above non-crystalline polyol exceeds 10000, preferable coating properties may be hardly obtained since the viscosity becomes high.

On the other hand, the number average molecular weight (Mn) of the crystalline polyol is preferably from 1000 to 10000. If the number average molecular weight (Mn) of the crystalline polyol is less than 1000, the cured adhesive may be become too rigid. On the other hand, if the number average molecular weight (Mn) of the crystalline polyol is more than 10000, preferable coating properties may be hardly obtained since the viscosity becomes high.

Here, the number average molecular weight (Mn) is a value calculated out by gel permeation chromatography (GPC method).

The measurement of the number average molecular weight (Mn) by using the gel permeation chromatography (GPC method) may be performed by the following condition.

Solvlent: tetrahydrofuran.

Standard sample: polystyrene.

Concentration of sample: 0.25 mass/volume %.

Column temperature: 23° C.

The blending ratio of the non-crystalline polyol is preferably from 20% by mass to 90% by mass (20% by mass or more and 90% by mass or less) with respect to the whole polyols, more preferably from 20% by mass to 80% by mass with respect to the whole polyols. If the blending ratio of the non-liquid crystalline polyol is less than 20% by mass with respect to the whole polyols, the open time (time during which an adhesive can be applied) becomes short, so that workability may be deteriorated. On the other hand, if the blending ratio of the non-crystalline polyol exceeds 90% by mass, preferable initial adhesion strength may be hardly obtained since initial cohesion strength becomes low.

The blending ratio of the crystalline polyol is preferably from 10% by mass to 80% by mass with respect to the whole polyols, more preferably from 20% by mass to 80% by mass with respect to the whole polyols. If the blending ratio of the crystalline polyol is less than 10% by mass, preferable initial adhesion strength may be hardly obtained. On the other hand, if the blending ratio of the crystalline polyol exceeds 80% by mass, the open time may become short.

The adhesive used in the manufacturing method of the present invention contains not only the non-crystalline polyol but also the crystalline polyol as essential components since it needs high cohesion at the initial stage of adhesion in order to inhibit the camber of the adherend. One of the characteristics of the reactive hot-melt adhesive used in the present invention is that it contains the non-crystalline polyol and the crystalline polyol in moderate amounts.

The non-crystalline polyol is also referred to as an amorphous polyol and it refers to a polyol having no crystallinity. Therefore, the non-crystalline polyol is a polyol not having a clear melting point and having only a glass transition point (Tg).

As the non-crystalline polyol, for example, polypropylene glycol, polycaprolactone diol, polyester polyol, polyether polyol, polyalkylene polyol, and the like may be cited. As the specific example of the polyester polyol, polyester polyol (showing a liquid form at normal temperature) obtained by reacting polycalboxylic acid with polyalcohol and the like may be cited. As the polycalboxylic acid, for example, dicarboxylic acids such as maleic acid, fumaric acid, succinic acid, glutaric acid, adipic acid, azelaic acid, sebacic acid, orthophthalic acid, isophthalic acid, terephthalic acid, naphthalene dicalboxylic acid, and the like may be cited. As the polyalcohol, for example, glycols such as ethylene glycol, propylene glycol, 1,4-butanediol, neopentyl glycol, diethylene glycol, and the like may be cited. As the above polyether polyol, for example, polyethylene glycol, polytetramethylene glycol, and the like may be cited. As the above polyalkylene polyol, polybutadiene polyol, polybutadiene polyol hydride, polyisoprene polyol hydride, and the like may be cited.

Further, examples of the non-crystalline polyols other than the above non-crystalline polyols include polyols (showing a liquid state at normal temperature) which are molecules obtained by a reaction of abietic acids or modified products thereof with polyesters or polyethers having a functional group (for example, an epoxy group, an amino group, etc.) capable of reacting with the abietic acids or modified products thereof, and are formed by introducing a rosin skeleton in the branched form in the end or the chain of the aforementioned molecule.

The crystalline polyol refers to a polyol which indicates a clear peak of a melting point in a range of 10 to 80° C. and has an endothermic value of 50 J/g or more caused by melting of this crystal in measuring DSC according to JIS K 7121 "Measuring methods for transition temperatures of plastics".

As the crystalline polyol, for example, polyester polyol and the like may be cited. As the specific example of the polyester polyol, polyester polyol obtained by reacting polycalboxylic acid with polyalcohol and the like may be cited. As the polycalboxylic acid, for example, dicalboxylic acids such as terephthalic acid, 2,6-naphthalene dicalboxylic acid, adipic acid, pimelic acid, suberic acid, azelaic acid, sebacic acid, nonamethylene dicalboxylic acid, decamethylene dicalboxylic acid, undecamethylene dicalboxylic acid, dodecamethylene dicalboxylic acid, and the like may be cited. As the polyalcohol, ethylene glycol, propylene glycol, 1,4-butanediol, 1,5-pentanediol, 1,6-hexanediol, 1,7-heptanediol, 1,8-octanediol, 1,9-nonanediol, 1,10-decanediol, and the like may be cited.

The crystalline polyol and the non-crystalline polyol may be obtained by condensation reaction of the above polycalboxylic acid and the polyalcohol, respectively.

As the hydroxyl group-containing (meth)acrylate (C), 2-hydroxyethyl (meth)acrylate, 2-hydroxypropyl (meth) acrylate, butanediolmono (meth)acrylate, caprolactone-modified 2-hydroxyethyl (meth)acrylate, glycidol di(meth) acrylate, pentaerythritol tri(meth)acrylate, and the other publicly known one may be cited. These hydroxyl group-containing (meth)acrylates (C) may be used singly or in combination of two or more kinds. In the present invention, the (meth)acrylate refers to acrylate or methacrylate.

In order to obtain the polyurethane prepolymer having an isocyanate group at the end of a molecule, it is necessary that the total amounts of isocyanate groups in the polyisocyanate (A) is larger than those of hydroxyl groups in the polyol (B) and the hydroxyl group-containing (meth)acrylate (C).

Therefore, when the polyurethane prepolymer is synthesized, a reaction is performed in such a way that a ratio (hereinafter, referred to as a "ratio NCO/OH") of the total amounts of isocyanate groups in the polyisocyanate (A) to the total amounts of hydroxyl groups in the polyol (B) and hydroxyl groups in the hydroxyl group-containing (meth) acrylate (C) is 1.2 or more and 3.0 or less, preferably more than 1.5 and 3.0 or less, more preferably more than 1.5 and 2.5 or less, and particularly preferably 1.6 or more and 2.3 or less. In the polyurethane prepolymer in which a ratio (ratio NCO/OH) of an isocyanate group to a hydroxyl group is less than 1.2, the viscosity becomes too high, and on the other hand, the polyurethane prepolymer in which a ratio of an isocyanate group to a hydroxyl group is more than 3.0 may cause significant foaming during moisture-curing.

Further, when the polyurethane prepolymer is synthesized, a reaction is performed in such a way that a ratio (acryloyl group/isocyanate group) between the total amounts of (meth) acryloyl groups and the total amounts of isocyanate groups, which are respectively present at the end of a molecule of the polyurethane prepolymer, is from 0.1 to 0.6, and preferably from 0.2 to 0.4. When this ratio is less than 0.1, adequate initial adhesion strength may not be attained since the proportion of the polyurethane prepolymer polymerized through a radical reaction of the (meth)acryloyl group caused by ultraviolet irradiation is reduced. On the other hand, when the ratio is more than 0.6, the proportion of polymerization of the polyurethane prepolymer becomes too large, so that tackiness in a melting state required for bonding is impaired.

A reactive hot-melt adhesive composition contains a photopolymerization initiator in order to facilitate the occurrence of a radical reaction of the polyurethane prepolymer by ultraviolet irradiation. Examples of the photopolymerization initiator include publicly known polymerization initiators such as benzyl dimethyl ketal, benzoin ethyl ether, benzoin isopropyl ether, 1-hydroxycyclohexylphenyl ketone, 2-hydroxy-2-methyl-1-phenylpropane-1-one and the like. These initiators may be used alone or may be used in combination of two or more species. The amount of the photopolymerization initiator is from 0.1 to 10% by mass, preferably from 0.5 to 5% by mass, and furthermore preferably from 1 to 3% by mass with respect to the whole composition.

Furthermore, a variety of polymerization inhibitors may be added to the reactive hot-melt adhesive composition. Examples of the polymerization inhibitors include publicly known polymerization inhibitors such as hydroquinone, hydroquinone monomethyl ether, benzoquinone, p-t-butylcathecol, 2,6-dibutyl-4-methyl phenol, and the like. These inhibitors may be used alone or may be used in combination of two or more species. The amount of the polymerization inhibitor is preferably from 0.01 to 1% by mass with respect to the whole composition.

Further, various additives other than the above agents may be added to the reactive hot-melt adhesive composition as required. Examples of the additives include plasticizers, antioxidants, antifoaming agents, leveling agents, nucleating agents, flame retarders, fillers, tackifying resins, dyes, pigments, and ultraviolet absorbers.

The usage of the above reactive hot-melt adhesive composition is such that the adhesive composition is heated at 80° C. to 100° C. to melt it and then applied to adherends. Next, after irradiating the applied surface of the adhesive with ultraviolet light, the adherends are overlaid and bonded each other. In this case, the amount of ultraviolet irradiation is preferably more than 100 mJ/cm$^2$ and less than 1200 mJ/cm$^2$, more preferably 200 mJ/cm$^2$ or more and 1100 mJ/cm$^2$ or less, and particularly preferably 250 mJ/cm$^2$ or more and 1050 mJ/cm$^2$ or less. Because if the amount of ultraviolet irradiation is 100 mJ/cm$^2$ or less, the urethane prepolymer is not polymerized, on the other hand, if the amount of ultraviolet irradiation is 1200 mJ/cm$^2$ or more, the urethane prepolymer is polymerized excessively.

As the specific example of the above reactive hot-melt adhesive, an hot-melt adhesive, in which the viscosity at 80° C. after the irradiation of ultraviolet light having irradiation energy more than 100 mJ/cm$^2$ and less than 1200 mJ/cm$^2$ is at least three times larger than that at 80° C. before the irradiation of the ultraviolet light, is preferable. The reason is that if the rate of increase in the viscosity (viscosity at 80° C. after ultraviolet light irradiation/viscosity at 80° C. before ultraviolet light irradiation) is less than three times, the adhesive may not be polymerized to a level at which the adhesive has adequate initial adhesion strength. On the other hand, an upper limit of the rate of increase in the viscosity is preferably 200 times. The reason for this is that if the rate of increase in the viscosity is more than 200 times, the tackiness of the adhesive is deteriorated and another adherend may not be bonded to the adhesive when another adherend joins to the adhesive.

Also, a ratio between viscosities (viscosity at 60° C./viscosity at 80° C.) of the reactive hot-melt adhesive after the irradiation of ultraviolet light is preferably 2.3 or more and more preferably 2.5 or more. In the case where the ratio between viscosities (viscosity at 60° C./viscosity at 80° C.) is less than 2.3, the difference between viscosities at 80° C. (the temperature when the adhesive is applied to the adherend) and 60° C. (the temperature when the adherends are bonded each other) becomes small. This is because, as above, if the difference between viscosities becomes small, the viscosity at 80° C. becomes too high, or initial adhesion strengh at 60° C. becomes insufficient.

On the other hand, the upper limit of the above ratio between viscosities (viscosity at 60° C./viscosity at 80° C.) is preferably 5.0. If the ratio is more than 5.0, the difference between viscosities at the above temperatures becomes too large, so that control of a coating temperature and a bonding temperature is difficult.

The adhesive, in which the viscosity at 80° C. after the irradiation of ultraviolet light of more than 100 mJ/cm$^2$ and less than 1200 mJ/cm$^2$ is three time or more larger than that at 80° C. before the irradiation of the ultraviolet light and a ratio between the viscosity at 80° C. and the viscosity at 60° C. after ultraviolet irradiation (viscosity at 60° C./viscosity at 80° C.) is 2.3 or more, can be obtained by using, for example, the following procedure.

A usual reactive hot-melt adhesive not containing acrylate is prepared, and thereafter, hydroxyl group-containing acrylate, an acrylic polymerization inhibitor, and a photopolymerization initiator are added to the reactive hot-melt adhesive to acrylate from 10% to 40% of the total number of isocyanate groups. The proportion of acrylating the isocyanate group is preferably from 10% to 40%, and more preferably from 15% to 35%. The reason for this is that if the proportion of acrylating the isocyanate group is less than 10%, the viscosity at 80° C. after the irradiation of ultraviolet light becomes three times or less with respect to the viscosity at 80° C. before the irradiation of the ultraviolet light. Further, the reason for this is that if the proportion of acrylating the isocyanate group is 40% or more, the ratio between the viscosity at 80° C. and the viscosity at 60° C. after ultraviolet irradiation (viscosity at 60° C./viscosity at 80° C.) becomes less than 2.3.

In the above reactive hot-melt adhesive, after ultraviolet irradiation, moisture-curing proceeds by aging the adhesive at room temperature (for example, 5 to 35° C.) or in a state of being humidified and heated (for example, 35° C., 80% RH) to obtain ultimate adhesion strength.

(About Shoes and Adherend)

The manufacturing method of the present invention can be applied to the production of publicly known shoes such as sporting shoes for various sports, sneakers, walking shoes, boots, sandals, and Loafer.

The constituent members (adherends) of the shoes are separated into shoes body (parts covering dorsum of foot and sole) and out sole (bottom parts coming into contact with ground). Specifically, sneaker, as an example of shoes, is generally composed of constituent members such as upper parts, insole, midsole, outsole, heel, toe, and shoelace. Materials selected from synthetic rubbers, natural rubbers, elastomers, and foams made of a synthetic resin are often used for the upper parts, the insole, the midsole, and the outsole of the above constituent members.

In the present invention, shoes can be manufactured by bonding the constituent members of shoes together using the above reactive hot-melt adhesive. However, the present invention is not limited to the case where all of these constituent members are bonded together using the above reactive hot-melt adhesive. In the present invention, at least a part of these constituent members may be bonded together using the above reactive hot-melt adhesive. Particularly, it is preferable that at least the outsole of the constituent members of shoes is bonded with the hot-melt adhesive. Further, the joining surfaces of the constituent members (adherends) of shoes may be shaped into irregularities.

Furthermore, the shoes have many parts formed into a shape of radii such as a toe portion, a heel portion, and a shank portion. When a rubber sole is bonded to such radii-like portions of shoes, a joining surface is apt to peel due to material repulsion. In this respect, the constituent member such as the rubber sole can be bonded to the radii-like portion of shoes by employing the above reactive hot-melt adhesive.

(Method of Manufacturing Shoes)

Next, the procedure of the method of manufacturing shoes will be described.

The constituent members of shoes and the reactive hot-melt adhesive are prepared.

As a pre-step, an adhesive composition (reactive hot-melt adhesive), in which the above various components are mixed, is heated to a predetermined temperature to be melted to a level where the adhesive can be applied. The heating temperature is preferably from 80 to 100° C. and more preferably from 80 to 90° C. If the heating temperature is 80 or less, the reactive hot-melt adhesive may not be melted sufficiently, and if the heating temperature is more than 100° C., the material of constituent members of shoes (constituent members such as rubber, elastomer, foam material of synthetic resin, and the like) may be deteriorated.

This reactive hot-melt adhesive is applied to a joining surface of at least one adherend. The reactive hot-melt adhesive may be applied to joining surfaces of both adherends, respectively. However, the reactive hot-melt adhesive of the present invention has moderate viscosity after ultraviolet irradiation. Therefore, the reactive hot-melt adhesive of the present invention can bond two adherends well together even when being applied to only one adherend. Accordingly, the manufacturing method of the present invention may be a manner of applying the adhesive to one adherend, so that the manufacturing method of the present invention can simplify an application work in comparison with a manner of applying the adhesive to both adherends.

Further, generally, if the joining surface of the adherend has the irregularities, it is difficult to apply the adhesive to the joining surface having the irregularities. In this regard, in accordance with the manufacturing method of the present invention, both adherends can be bonded well together even when applying the reactive hot-melt adhesive to the joining surface of one adherend without applying the adhesive to the joining surface of another adherend as described above. Thus, the present invention can bond both adherends together by applying the adhesive to a more flat joining surface to which the reactive hot-melt adhesive can be applied with relative ease. In this regard, a work of applying the adhesive can be easily performed.

The coating method of the reactive hot-melt adhesive is not particularly limited, so that coater devices such as a roll coater, a knife coater, a spray coater, and the like may be used in coating. Also, the adhesive may be coated manually.

The thickness of the adhesive is not particularly limited but preferably from 50 μm to 300 μm.

Also, primer treatment is preferably performed on the joining surface of the adherend before the adhesive is applied. The primer treatment is not particularly limited. Examples of the primer treatment which can improve adhesive properties include, for example, a treatment such that solvent based primer such as chloroprene based, ethylene-vinyl acetate copolymer based and urethane based, or emulsion based primer is applied to joining surface of the adherend.

Here, in applying the adhesive, a reactive hot-melt adhesive formed into a shape of sheet can also be used. As the sheet-like adhesive, for example, a substance formed by applying the reactive hot-melt adhesive solidly onto a release paper can be employed. Such the sheet-like adhesive can be transferred to the joining surface of the adherend by heating it to the above temperature to melt, overlaying the adhesive on the joining surface of the adherend, and peeling the release paper. By using the adhesive formed into a shape of sheet, maintenance of an apparatus such as a work of wiping out the adhesive is not necessary. Therefore, the work of applying the adhesive to the joining surface of the adherend can be simply performed.

Next, ultraviolet light is irradiated to the adhesive to polymerize the polyurethane prepolymer in the reactive hot-melt adhesive as an ultraviolet treating step. The amount of irradiation of the ultraviolet light is more than 100 mJ/cm$^2$ and less than 1200 mJ/cm$^2$ as described above.

As the ultraviolet light, light of a wavelength of 200 nm to 400 nm beamed from a high-pressure mercury lamp or a metal halide lamp may be used.

By irradiating the ultraviolet light, the polyurethane prepolymer is polymerized and the reactive hot-melt adhesive exhibits initial adhesion strength of 490 N/m (about 1 kgf/2 cm) or more.

Next, the joining surface of one adherend, on which the adhesive is applied, is overlaid on the joining surface of another adherend and a pressure is applied to both adherends. The applied pressure is from about 30 KPa to 60 KPa and a time period during which a pressure is applied is from about 5 seconds to 60 seconds, and preferably from about 5 seconds to 20 seconds.

Since the above reactive hot-melt adhesive is superior in initial adhesion strength, the joining surface is not peeled off and both adherends can be bonded well together even though a time period during which a pressure is applied is short.

After the compression bonding, moisture-curing of the reactive hot-melt adhesive proceeds to complete shoes by storing the adhesive at room temperature.

In the resulting shoes, the adherends (constituent members) are bonded together at adhesion strength (7355 N/m), which can stand actual use. Further, since the reactive hot-melt adhesive is cured with moisture, there is not a probability that a bonded surface of the shoes is peeled off in the environment (in rainy weather and the like) of shoes usage. Accordingly, shoes having excellent durability can be provided.

EXAMPLES

Hereinafter, the present invention is further explained in detail by representing Examples and Comparative Examples. Here, the present invention is not limited to the following Examples. Also, "part" and "%" refer to "part by mass" and "% by mass" unless otherwise noted.

(Various Methods of Measurement)

(1) Measurement of Number Average Molecular Weight

The number average molecular weight was measured by the following condition by using gel permeation chromatography method (GPC method).

Solvlent: tetrahydrofuran.

Standard sample: polystyrene.

Concentration of sample: 0.25 mass/volume %.

Column temperature: 23° C.

(2) Measurement of Ratio NCO/OH and Content of Active Isocyanate

A ratio NCO/OH was determined from a ratio between the total of a hydroxyl group equivalent weight of the polyol and a hydroxyl group equivalent weight of the hydroxyl group-containing (meth)acrylate and an NCO equivalent weight of the isocyanate.

The content of active isocyanate was determined by the following analysis.

3 to 4 g of a measuring sample is put in an Erlenmeyer flask and 20 ml of a ½ normal (N) solution of di-n-butylamine (26 ml of di-n-butylamine is dissolved in toluene to form a 300 ml solution) is added to dissolve the sample in the solution. 100 ml of isopropyl alcohol is added and the resulting solution is titrated with ½ normal (N) hydrochloric acid using BCG (bromcresol green) as an indicator. A blank test is performed similarly.

The content of isocyanate is determined by the following equation:

$$NCO(\%)=(B-A)\times F\times 0.02101\times 100/W,$$

Here, in the above equation, "B" represents a titer (ml) of the blank test by ½ normal (N) hydrochloric acid, "A" represents a titer (ml) of the measuring sample (the test) by ½ normal (N) hydrochloric acid, "F" represents a factor of the ½ normal (N) hydrochloric acid, and "W" represents a sample weight (g).

(3) Measurement of Viscosity

Viscosity was measured with a BH type rotational viscometer. Specifically, one of No. 1 to No. 4 rotors was appropriately used at each measuring temperature and a sample amount (7 g to 14 g) which fits a rotor was put in the rotor and left at rest for 10 minutes, and then viscosity measurement was initiated at a rotational speed of 2 rpm to 20 rpm to measure the viscosity after a lapse of 10 minutes.

Production Example of Adhesive 1

Into a separable flask equipped with a stirrer, a temperature control unit, a reflux condenser, a nitrogen inlet tube, and a pressure reducing device, the following two species of polyester polyols were charged, and the resulting mixture was heated while stirring the mixture and the mixture was dehydrated at 80° C. under a reduced pressure.

a) Crystalline Polyester Polyol: 80 Parts.

The crystalline polyester polyol was a polyester polyol predominantly composed of 1,6-hexanediol and sebacic acid (number of functional groups: 2.0, number average molecular weight: 5000).

b) Non-Crystalline Polyester Polyol: 20 Parts.

The non-crystalline polyester polyol was a polyester polyol predominantly composed of ethylene glycol, neopentyl glycol, adipic acid and isophthalic acid (number of functional groups: 2.0, number average molecular weight: 2000).

12.3 parts of 4,4'-diphenylmethanediisocyanate was added to the above crystalline and non-crystalline polyester polyols under a nitrogen atmosphere and the resulting mixture was reacted at 110° C. for one hour. Furthermore, 1.1 parts of 2-hydroxyethyl acrylate and 0.11 part of hydroquinone monomethyl ether as a polymerization inhibitor were added and the resulting mixture was reacted at 110° C. for one hour. Next, 2.4 parts of 1-hydroxycyclohexylphenyl ketone as a polymerization initiator was added and the resulting mixture was mixed well to obtain a reactive hot-melt adhesive composition predominantly composed of a polyurethane prepolymer. This reactive hot-melt adhesive was solid form at normal temperature (23° C.) and the polyurethane prepolymer of the adhesive had a ratio NCO/OH of 1.6 and content of active isocyanate group was 1.0%.

Production Example of Adhesive 2

An adhesive composition (a ratio NCO/OH of the polyurethane prepolymer was 1.6, a content of active isocyanate group was 1.4%, and the composition was solid form at normal temperature (23° C.)) was obtained in the same way as in the above production example of the adhesive 1 except that the blending ratio was changed as follows. In this adhesive composition, the number average molecular weight (Mn) of the polyurethane prepolymer was 12600 and the polydispersity index of the polyurethane prepolymer (weight average molecular weight (Mw)/number average molecular weight (Mn)) was about 1.7.

a) Crystalline Polyester Polyol: 50 Parts.

The crystalline polyester polyol was a polyester polyol predominantly composed of 1,6-hexanediol and sebacic acid (number of functional groups: 2.0, number average molecular weight: 5000).

b) Non-Crystalline Polyester Polyol: 50 Parts.

The non-crystalline polyester polyol was a polyester polyol predominantly composed of ethylene glycol, neopentyl glycol, adipic acid, and isophthalic acid (number of functional groups: 2.0, number average molecular weight: 2000).

c) 4,4'-diphenylmethane diisocyanate: 16.5 parts.

d) 2-hydroxyethyl acrylate: 1.4 parts.

e) Hydroquinone monomethyl ether: 0.14 part.

f) 1-hydroxycyclohexylphenyl ketone: 2.4 parts.

Production Example of Adhesive 3

An adhesive composition (a ratio NCO/OH of the polyurethane prepolymer was 1.4, a content of active isocyanate group was 1.0%, and the composition was solid form at normal temperature (23° C.)) was obtained in the same way as in the above production example of the adhesive 1 except that the blending ratio was changed as follows. In this adhesive composition, the number average molecular weight (Mn) of the polyurethane prepolymer was 18200 and the polydispersity index of the polyurethane prepolymer (weight average molecular weight (Mw)/number average molecular weight (Mn)) was about 2.3.

a) Crystalline polyester polyol: 50 parts.

The crystalline polyester polyol was a polyester polyol predominantly composed of 1,6-hexanediol and sebacic acid (number of functional groups: 2.0, number average molecular weight: 5000).

b) Non-crystalline polyester polyol: 50 parts.

The non-crystalline polyester polyol was a polyester polyol predominantly composed of ethylene glycol, neopentyl glycol, adipic acid, and isophthalic acid (number of functional groups: 2.0, number average molecular weight: 2000).

c) 4,4'-diphenylmethane diisocyanate: 14.4 parts.

d) 2-hydroxyethyl acrylate: 1.1 parts.

e) Hydroquinone monomethyl ether: 0.11 part.

f) 1-hydroxycyclohexylphenyl ketone: 2.4 parts.

Production Example of Adhesive 4

An adhesive composition (a ratio NCO/OH of the polyurethane prepolymer was 1.6, a content of active isocyanate group was 0.9%, and the composition was solid form at normal temperature (23° C.)) was obtained in the same way as in the above production example of the adhesive 1 except that the blending ratio was changed as follows.

a) Crystalline polyester polyol: 100 parts.

The crystalline polyester polyol was a polyester polyol predominantly composed of 1,6-hexanediol and sebacic acid (number of functional groups: 2.0, number average molecular weight: 5000).

b) Non-crystalline polyester polyol: not blended.

c) 4,4'-diphenylmethane diisocyanate: 9.7 parts.

d) 2-hydroxyethyl acrylate: 0.9 part.

e) Hydroquinone monomethyl ether: 0.09 part.

f) 1-hydroxycyclohexylphenyl ketone: 2.4 parts.

Production Example of Adhesive 5

An adhesive composition (a ratio NCO/OH of the polyurethane prepolymer was 1.9, a content of active isocyanate group was 1.4%, and the composition was solid form at normal temperature (23° C.)) was obtained in the same way as in the above production example of the adhesive 1 except that the blending ratio was changed as follows.

a) Crystalline polyester polyol: 80 parts.

The crystalline polyester polyol was a polyester polyol predominantly composed of 1,6-hexanediol and sebacic acid (number of functional groups: 2.0, number average molecular weight: 5000).

b) Non-crystalline polyester polyol: 20 parts.

The non-crystalline polyester polyol was a polyester polyol composed of ethylene glycol, neopentyl glycol, adipic acid, and isophthalic acid (number of functional groups: 2.0, number average molecular weight: 2000).

c) 4,4'-diphenylmethane diisocyanate: 12.5 parts.

d) 2-hydroxyethyl acrylate: not blended.

e) Hydroquinone monomethyl ether: not blended.

f) 1-hydroxycyclohexylphenyl ketone: not blended.

Production Example of Adhesive 6

An adhesive composition (a ratio NCO/OH of the polyurethane prepolymer was 1.5, a content of active isocyanate group was 1.1%, and the composition was solid form at normal temperature (23° C.)) was obtained in the same way as in the above production example of the adhesive 1 except that the blending ratio was changed as follows. In this adhesive composition, the number average molecular weight (Mn) of the polyurethane prepolymer was 14300 and the polydispersity index of the polyurethane prepolymer (weight average molecular weight (Mw)/number average molecular weight (Mn)) was about 2.0.

a) Crystalline polyester polyol: 50 parts.

The crystalline polyester polyol was a polyester polyol predominantly composed of 1,6-hexanediol and sebacic acid (number of functional groups: 2.0, number average molecular weight: 5000).

b) Non-crystalline polyester polyol: 50 parts.

The non-crystalline polyester polyol was a polyester polyol predominantly composed of ethylene glycol, neopentyl glycol, adipic acid, and isophthalic acid (number of functional groups: 2.0, number average molecular weight: 2000).

c) 4,4'-diphenylmethane diisocyanate: 14.9 parts.

d) 2-hydroxyethyl acrylate: 1.1 parts.

e) Hydroquinone monomethyl ether: 0.11 part.

f) 1-hydroxycyclohexylphenyl ketone: 2.4 parts.

Production Example of Adhesive 7

An adhesive composition (a ratio NCO/OH of the polyurethane prepolymer was 1.7, a content of active isocyanate group was 2.0%, and the composition was solid form at normal temperature (23° C.)) was obtained in the same way as in the above production example of the adhesive 1 except that the blending ratio was changed as follows.

a) Crystalline polyester polyol: 20 parts.

The crystalline polyester polyol was a polyester polyol predominantly composed of 1,6-hexanediol and sebacic acid (number of functional groups: 2.0, number average molecular weight: 5000).

b) Non-crystalline polyester polyol: 80 parts.

The non-crystalline polyester polyol was a polyester polyol predominantly composed of ethylene glycol, neopentyl glycol, adipic acid, and isophthalic acid (number of functional groups: 2.0, number average molecular weight: 2000).

c) 4,4'-diphenylmethane diisocyanate: 22.0 parts.

d) 2-hydroxyethyl acrylate: 2.1 parts.

e) Hydroquinone monomethyl ether: 0.21 part.

f) 1-hydroxycyclohexylphenyl ketone: 2.4 parts.

Production Example of Adhesive 8

An adhesive composition (a ratio NCO/OH of the polyurethane prepolymer was 1.7, a content of active isocyanate group was 1.9%, and the composition was solid form at normal temperature (23° C.)) was obtained in the same way as in the above production example of the adhesive 1 except that the blending ratio was changed as follows.

a) Crystalline polyester polyol: 30 parts.

The crystalline polyester polyol was a polyester polyol predominantly composed of 1,6-hexanediol and sebacic acid (number of functional groups: 2.0, number average molecular weight: 5000).

b) Non-crystalline polyester polyol: 70 parts.

The non-crystalline polyester polyol was a polyester polyol predominantly composed of ethylene glycol, neopentyl glycol, adipic acid, and isophthalic acid (number of functional groups: 2.0, number average molecular weight: 2000).

c) 4,4'-diphenylmethane diisocyanate: 20.5 parts.

d) 2-hydroxyethyl acrylate: 2.0 parts.

e) Hydroquinone monomethyl ether: 0.20 part.

f) 1-hydroxycyclohexylphenyl ketone: 2.4 parts.

Production Example of Adhesive 9

An adhesive composition (a ratio NCO/OH of the polyurethane prepolymer was 1.6, a content of active isocyanate group was 1.9%, and the composition was solid form at normal temperature (23° C.)) was obtained in the same way as in the above production example of the adhesive 1 except that the blending ratio was changed as follows.

a) Crystalline polyester polyol: 5 parts.

The crystalline polyester polyol was a polyester polyol predominantly composed of 1,6-hexanediol and sebacic acid (number of functional groups: 2.0, number average molecular weight: 5000).

b) Non-crystalline polyester polyol: 95 parts.

The non-crystalline polyester polyol was a polyester polyol predominantly composed of ethylene glycol, neopentyl glycol, adipic acid, and isophthalic acid (number of functional groups: 2.0, number average molecular weight: 2000).

c) 4,4'-diphenylmethane diisocyanate: 23.5 parts.

d) 2-hydroxyethyl acrylate: 2.7 parts.

e) Hydroquinone monomethyl ether: 0.27 part.

f) 1-hydroxycyclohexylphenyl ketone: 2.4 parts.

Production Example of Adhesive 10

An adhesive composition (a ratio NCO/OH of the polyurethane prepolymer was 1.8, a content of active isocyanate group was 2.6%, and the composition was solid form at normal temperature (23° C.)) was obtained in the same way as in the above production example of the adhesive 1 except that the blending ratio was changed as follows.

a) Crystalline polyester polyol: not blended.

b) Non-crystalline polyester polyol: 100 parts.

The polyester polyol containing ethylene glycol, neopentyl glycol, adipic acid, and isophthalic acid as main components (number of functional groups: 2.0, number average molecular weight: 2000).

c) 4,4'-diphenylmethane diisocyanate: 27.0 parts.

d) 2-hydroxyethyl acrylate: 2.7 parts.

e) Hydroquinone monomethyl ether: 0.27 part.

f) 1-hydroxycyclohexylphenyl ketone: 2.4 parts.

Production Example of Adhesive 11

An adhesive composition (a ratio NCO/OH of the polyurethane prepolymer was 1.7, a content of active isocyanate group was 1.0%, and the composition was solid form at normal temperature (23° C.)) was obtained in the same way as in the above production example of the adhesive 1 except that the blending ratio was changed as follows.

a) Crystalline polyester polyol: 90 parts.

The crystalline polyester polyol was a polyester polyol predominantly composed of 1,6-hexanediol and sebacic acid (number of functional groups: 2.0, number average molecular weight: 5000).

b) Non-crystalline polyester polyol: 10 parts.

The non-crystalline polyester polyol was a polyester polyol predominantly composed of ethylene glycol, neopentyl glycol, adipic acid, and isophthalic acid (number of functional groups: 2.0, number average molecular weight: 2000).

c) 4,4'-diphenylmethane diisocyanate: 11.6 parts.

d) 2-hydroxyethyl acrylate: 1.1 parts.

e) Hydroquinone monomethyl ether: 0.11 part.

f) 1-hydroxycyclohexylphenyl ketone: 2.4 parts.

The adhesives 1 to 11 were heated at 80° C. to melt them respectively and the viscosity of the adhesives at 80° C. was measured respectively. The results of measurement are shown in Table 1.

Also, using a roll coater heated to 80° C., the adhesives 1 to 11 were respectively applied onto an olefin sheet with a primer so as to be about 100 g/m$^2$. Appearances of the adhesives applied were visually rated. The results are shown in Table 1. Here, the case where the adhesive is uniformly applied by a visual check is represented by a symbol "○" and the case where the adhesive is partially nonuniformly applied by a visual check is represented by a symbol "×".

TABLE 1

| | Adhesive 1 | Adhesive 2 | Adhesive 3 | Adhesive 4 | Adhesive 5 | Adhesive 6 |
|---|---|---|---|---|---|---|
| Crystalline polyol (part) | 80 | 50 | 50 | 100 | 80 | 50 |
| Non-crystalline polyol (part) | 20 | 50 | 50 | 0 | 20 | 50 |
| NCO/OH | 1.6 | 1.6 | 1.4 | 1.6 | 1.9 | 1.5 |
| Viscosity at 80° C. (Pa · s) | 110 | 140 | 750 | 100 | 100 | 350 |
| Coating Properties (80° C.) | ○ | ○ | x | ○ | ○ | x |

| | Adhesive 7 | Adhesive 8 | Adhesive 9 | Adhesive 10 | Adhesive 11 |
|---|---|---|---|---|---|
| Crystalline polyol (part) | 20 | 30 | 5 | 0 | 90 |
| Non-crystalline polyol (part) | 80 | 70 | 95 | 100 | 10 |
| NCO/OH | 1.7 | 1.7 | 1.6 | 1.8 | 1.7 |
| Viscosity at 80° C. (Pa · s) | 90 | 100 | 100 | 80 | 100 |
| Coating Properties (80° C.) | ○ | ○ | ○ | ○ | ○ |

Example 1

Using a roll coater heated to 80° C., the above adhesive 1 was applied onto an olefin sheet with a primer so as to be about 100 g/m$^2$. Ultraviolet light of 300 mJ/cm$^2$ was irradiated to the adhesive 1 using a metal halide lamp. This olefin sheet was left to stand in an atmosphere of 20° C. and a time (open time) lapsed until the tackiness of the surface of the adhesive becomes lost by finger touch was measured. The results of measurement are shown in Table 2.

Next, 50 g of the adhesive 1 was taken and heated to 80° C. to be melted, and then ultraviolet light of 300 mJ/cm$^2$ was irradiated to the adhesive 1 using a metal halide lamp. The viscosities at 80° C. immediately before the irradiation of ultraviolet light and immediately after the irradiation of ultraviolet light were respectively measured to determine the rate of increase in the viscosity (viscosity after irradiation/viscosity before irradiation).

Further, after the ultraviolet irradiation, the adhesive was left to stand until the temperature was decreased from 80° C. to 60° C. and the viscosity at 60° C. was measured to determine a ratio between the viscosities after ultraviolet irradiation (viscosity at 60° C. after ultraviolet irradiation/viscosity at 80° C. after ultraviolet irradiation). The results of measurement are shown in Table 2. Here, the viscosity was measured by the same method as in the above description.

Next, two thermoplastic polyurethane sheets (manufactured by BASF Japan Ltd., trade name: Elastollan ET595) of 2 mm in thickness were prepared. The above adhesive 1 was applied onto one surface of one polyurethane sheet so as to be about 100 g/m$^2$ using a roll coater heated to 80° C. Thereafter, the ultraviolet light of 300 mJ/cm$^2$ was irradiated to the surface of the adhesive 1 using a metal halide lamp. After the irradiation, immediately, another polyurethane sheet was bonded to the adhesive 1 and bonded sheet was subjected to compression bonding at a pressure of 49 KPa for 10 seconds using a press machine. Adhesion strength (initial adhesion strength) at T-peel test was measured at a peel speed of 50 mm/min within one minute after the compression bonding. Furthermore, the bonded polyurethane sheet was aged at 23° C. and at 65% RH for 7 days after the compression bonding, and the adhesion strength (adhesion strength after curing) was measured similarly. The results of measurement are shown in Table 2.

TABLE 2

| | Example 1 | Example 2 | Example 3 | Example 4 | Example 5 | Example 6 | Example 7 | Example 8 |
|---|---|---|---|---|---|---|---|---|
| Used adhesive | Adhesive 1 | Adhesive 1 | Adhesive 2 | Adhesive 2 | Adhesive 2 | Adhesive 2 | Adhesive 7 | Adhesive 8 |
| Amount of ultraviolet irradiation (mJ/cm$^2$) | 300 | 1000 | 300 | 600 | 100 | 1100 | 1000 | 1000 |
| Open time (sec) | 30 | 30 | 180 | 180 | 180 | 180 | 390 | 420 |
| Rate of increase in viscosity after irradiation (times) | 8.0 | 19.0 | 9.0 | 13.0 | 3.0 | 20.0 | 12.0 | 11.3 |
| Viscosity ratio after irradiation | 3.8 | 2.6 | 3.6 | 2.8 | 3.7 | 2.6 | 2.5 | 2.6 |
| Initial adhesion strength (N/m) | 520 | 600 | 640 | 660 | 510 | 700 | 490 | 500 |
| Adhesion strength after curing (N/m) | 2000 or higher | 2000 or higher | 2000 or higher | 2000 or higher | 2000 or higher | 2000 or higher | 2000 or higher | 2000 or higher |

| | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 |
|---|---|---|---|---|---|---|---|---|---|
| Used adhesive | Adhesive 3 | Adhesive 1 | Adhesive 2 | Adhesive 4 | Adhesive 5 | Adhesive 6 | Adhesive 9 | Adhesive 10 | Adhesive 11 |
| Amount of ultraviolet irradiation (mJ/cm$^2$) | 100 | 50 | 1200 | 300 | — | 400 | 1100 | 800 | 400 |
| Open time (sec) | 120 | 30 | 180 | 3 | 30 | 180 | 600 or higher | 600 or higher | 5 |

TABLE 2-continued

| | | | | | | | | | |
|---|---|---|---|---|---|---|---|---|---|
| Rate of increase in viscosity after irradiation (times) | 3.2 | 2.5 | 23.0 | 8.0 | — | 3.0 | 20.0 | 16.0 | 8.5 |
| Viscosity ratio after irradiation | 2.7 | 2.3 | 2.2 | 3.8 | — | 2.6 | 2.3 | 3.2 | 3.6 |
| Initial adhesion strength (N/m) | 600 | 320 | 240 | 360 | 320 | 600 | 400 | 380 | 400 |
| Adhesion strength after curing (N/m) | 2000 or higher | 2000 or higher | 2000 or higher | 2000 or higher | 2000 or higher | 2000 or higher | 2000 or higher | 2000 or higher | 2000 or higher |

Example 2

An open time, a rate of increase in viscosity and a viscosity ratio, and adhesion strength (initial adhesion strength) and adhesion strength after aging (adhesion strength after curing) were measured in the same manner as in Example 1 except that the amount of ultraviolet irradiation was changed to 1000 mJ/cm$^2$. The results of measurement are shown in Table 2.

Example 3

An open time, a rate of increase in viscosity and a viscosity ratio, and adhesion strength (initial adhesion strength) and adhesion strength after aging (adhesion strength after curing) were measured in the same manner as in Example 1 except that the adhesive 1 was changed to the adhesive 2. The results of measurement are shown in Table 2.

Example 4

An open time, a rate of increase in viscosity and a viscosity ratio, and adhesion strength (initial adhesion strength) and adhesion strength after aging (adhesion strength after curing) were measured in the same manner as in Example 1 except that the adhesive 1 was changed to the adhesive 2 and the amount of ultraviolet irradiation was changed to 600 mJ/cm$^2$. The results of measurement are shown in Table 2.

Example 5

An open time, a rate of increase in viscosity and a viscosity ratio, and adhesion strength (initial adhesion strength) and adhesion strength after aging (adhesion strength after curing) were measured in the same manner as in Example 1 except that the adhesive 1 was changed to the adhesive 2 and the amount of ultraviolet irradiation was changed to 100 mJ/cm$^2$. The results of measurement are shown in Table 2.

Example 6

An open time, a rate of increase in viscosity and a viscosity ratio, and adhesion strength (initial adhesion strength) and adhesion strength after aging (adhesion strength after curing) were measured in the same manner as in Example 1 except that the adhesive 1 was changed to the adhesive 2 and the amount of ultraviolet irradiation was changed to 1100 mJ/cm$^2$. The results of measurement are shown in Table 2.

Example 7

An open time, a rate of increase in viscosity and a viscosity ratio, and adhesion strength (initial adhesion strength) and adhesion strength after aging (adhesion strength after curing) were measured in the same manner as in Example 1 except that the adhesive 1 was changed to the adhesive 7 and the amount of ultraviolet irradiation was changed to 1000 mJ/cm$^2$. The results of measurement are shown in Table 2.

Example 8

An open time, a rate of increase in viscosity and a viscosity ratio, and adhesion strength (initial adhesion strength) and adhesion strength after aging (adhesion strength after curing) were measured in the same manner as in Example 1 except that the adhesive 1 was changed to the adhesive 8 and the amount of ultraviolet irradiation was changed to 1000 mJ/cm$^2$. The results of measurement are shown in Table 2.

Comparative Example 1

An open time, a rate of increase in viscosity and a viscosity ratio, and adhesion strength (initial adhesion strength) and adhesion strength after aging (adhesion strength after curing) were measured in the same manner as in Example 1 except that the adhesive 1 was changed to the adhesive 3 and the amount of ultraviolet irradiation was changed to 100 mJ/cm$^2$. The results of measurement are shown in Table 2.

Comparative Example 2

An open time, a rate of increase in viscosity and a viscosity ratio, and adhesion strength (initial adhesion strength) and adhesion strength after aging (adhesion strength after curing) were measured in the same manner as in Example 1 except that the amount of ultraviolet irradiation was changed to 50 mJ/cm$^2$. The results of measurement are shown in Table 2.

Comparative Example 3

An open time, a rate of increase in viscosity and a viscosity ratio, and adhesion strength (initial adhesion strength) and adhesion strength after aging (adhesion strength after curing) were measured in the same manner as in Example 1 except that the adhesive 1 was changed to the adhesive 2 and the amount of ultraviolet irradiation was changed to 1200 mJ/cm$^2$. The results of measurement are shown in Table 2.

Comparative Example 4

An open time, a rate of increase in viscosity and a viscosity ratio, and adhesion strength (initial adhesion strength) and adhesion strength after aging (adhesion strength after curing) were measured in the same manner as in Example 1 except that the adhesive 1 was changed to the adhesive 4. The results of measurement are shown in Table 2.

Comparative Example 5

An open time, a rate of increase in viscosity and a viscosity ratio, and adhesion strength (initial adhesion strength) and adhesion strength after aging (adhesion strength after curing) were measured in the same manner as in Example 1 except that the adhesive 1 was changed to the adhesive 5 and ultraviolet light was not irradiated. The results of measurement are shown in Table 2.

Comparative Example 6

An open time, a rate of increase in viscosity and a viscosity ratio, and adhesion strength (initial adhesion strength) and adhesion strength after aging (adhesion strength after curing) were measured in the same manner as in Example 1 except that the adhesive 1 was changed to the adhesive 6 and the amount of ultraviolet irradiation was changed to 400 mJ/cm$^2$. The results of measurement are shown in Table 2.

Comparative Example 7

An open time, a rate of increase in viscosity and a viscosity ratio, and adhesion strength (initial adhesion strength) and adhesion strength after aging (adhesion strength after curing) were measured in the same manner as in Example 1 except that the adhesive 1 was changed to the adhesive 9 and the amount of ultraviolet irradiation was changed to 1100 mJ/cm$^2$. The results of measurement are shown in Table 2.

Comparative Example 8

An open time, a rate of increase in viscosity and a viscosity ratio, and adhesion strength (initial adhesion strength) and adhesion strength after aging (adhesion strength after curing) were measured in the same manner as in Example 1 except that the adhesive 1 was changed to the adhesive 10 and the amount of ultraviolet irradiation was changed to 800 mJ/cm$^2$. The results of measurement are shown in Table 2.

Comparative Example 9

An open time, a rate of increase in viscosity and a viscosity ratio, and adhesion strength (initial adhesion strength) and adhesion strength after aging (adhesion strength after curing) were measured in the same manner as in Example 1 except that the adhesive 1 was changed to the adhesive 11 and the amount of ultraviolet irradiation was changed to 400 mJ/cm$^2$. The results of measurement are shown in Table 2.

<Evaluation>

The adhesives 1, 2, 7 and 8 used in Examples 1 to 8 have the viscosity at which the adhesives can be applied well at 80° C. Furthermore, in Examples 1 to 8, it was verified that the adhesives are suitable for adhesion for shoes since they have a long open time after ultraviolet irradiation and further have high initial adhesion strength and high adhesion strength after curing.

On the other hand, the adhesives 3 and 6 used in Comparative Examples 1 and 6 are unsuitable for adhesion because they have high viscosity at 80° C. and are low in coating properties. Here, the adhesives 3 and 6 have the same blending ratio between the crystalline polyol and the non-crystalline polyol as in the adhesive 2. But, in each of the adhesives 3 and 6, since a ratio (NCO/OH) of the isocyanate group to the hydroxyl group in the polyurethane prepolymer is less than 1.6, a molecular weight of the polyurethane prepolymer is large and therefore the viscosity at 80° C. increases.

Further, in Comparative Example 2, adequate initial adhesion strength was not attained. It is thought that the reason for this is that in Comparative Example 2, the polyurethane prepolymer was not polymerized since the amount of ultraviolet irradiation was too small.

Also in Comparative Example 3, adequate initial adhesion strength was not attained. It is thought that the reason for this is that in Comparative Example 3, the polyurethane prepolymer was polymerized excessively since the amount of ultraviolet irradiation was too large.

In Comparative Examples 4 and 9, since the adhesives have an extremely short open time after ultraviolet irradiation, this interferes with a bonding work. It is thought that the reason for this is that in the adhesives 4 and 11 used in Comparative Examples 4 and 9, since the amounts of the mixed non-crystalline polyols were 10 parts or less, crystallization proceeds too fast.

In Comparative Example 5, adequate initial adhesion strength was not attained. It is thought that the reason for this is that in Comparative Example 5, the polyurethane prepolymer was not polymerized since the ultraviolet irradiation was not performed.

Also in Comparative Examples 7 and 8, adequate initial adhesion strength was not attained. It is thought that the reason for this is that in the adhesives 9 and 10 used in Comparative Examples 7 and 8, their open times were too long since the amounts of the mixed crystalline polyols were 5 parts or less, and therefore crystallization rates were too late or crystallization did not occur.

What is claimed is:

1. A method of manufacturing shoes comprising a pre-step of heating a reactive hot-melt adhesive to melt it and providing the melted adhesive on a joining surface of at least one adherend, an ultraviolet treating step of irradiating the adhesive with ultraviolet light having irradiation energy more than 100 mJ/cm$^2$ and less than 1200 mJ/cm$^2$ to polymerize a polyurethane prepolymer, and a joining step of overlaying a joining surface of another adherend on the adhesive to bond both adherends together, wherein the reactive hot-melt adhesive contains the polyurethane prepolymer including a non-crystalline polyol and a crystalline polyol and having an (meth)acryloyl group and an isocyanate group at the end of a molecule, and a photopolymerization initiator, and the viscosity of the reactive hot-melt adhesive at 80° C. is 300 Pa·s or less, wherein the amount of the non-crystalline polyol contained in the polyurethane prepolymer is 20% by mass or more and 90% by mass or less with respect to the whole polyols, wherein the amount of the crystalline polyol contained in the polyurethane prepolymer is 10% by mass or more and 80% by mass or less with respect to the whole polyols, wherein a ratio (NCO/OH) of the isocyanate group (NCO) to a hydroxyl group (OH) in the polyurethane prepolymer is more than 1.5 and 3.0 or less, and wherein a ratio (acryloyl group/isocyanate group) between the total amounts of (meth)acryloyl groups and the total amounts of isocyanate groups, which are respectively present at the end of a molecule of the polyurethane prepolymer, is from 0.1 to 0.6.

2. The method of manufacturing shoes according to claim 1, wherein the non-crystalline polyol has a number average molecular weight (Mn) of 1000 to 10000.

3. The method of manufacturing shoes according to claim 1, wherein the viscosity of the reactive hot-melt adhesive at 80° C. after the irradiation of ultraviolet light having irradiation energy more than 100 mJ/cm$^2$ and less than 1200 mJ/cm$^2$ is at least three times larger than the viscosity at 80° C. before the irradiation of the ultraviolet light.

4. The method of manufacturing shoes according to claim 1, wherein a ratio between viscosities (viscosity at 60° C./viscosity at 80° C.) of the reactive hot-melt adhesive after the irradiation of ultraviolet light having irradiation energy more than 100 mJ/cm$^2$ and less than 1200 mJ/cm$^2$ is 2.3 or more.

5. The method of manufacturing shoes according to claim 1, wherein the polyurethane prepolymer is synthesized from polyisocyanate, polyols containing a non-crystalline polyol and a crystalline polyol, and hydroxyl group-containing (meth)acrylate.

6. The method of manufacturing shoes according to claim 1, wherein the pre-step is a step of heating the reactive hot-melt adhesive processed into sheet form to melt it and providing the melted sheet-like adhesive on a joining surface of one adherend.

7. The method of manufacturing shoes according to claim 1, wherein the joining surface of one adherend is planar and the joining surface of another adherend has the irregularities.

8. Shoes, wherein a part or the whole of constituent members of the shoes are bonded together with a reactive hot-melt adhesive containing a polyurethane prepolymer having a (meth)acryloyl group and an isocyanate group at the end of a molecule and including the non-crystalline polyol and the crystalline polyol, and a photopolymerization initiator, wherein the amount of the non-crystalline polyol contained in the polyurethane prepolymer is 20% by mass or more and 90% by mass or less with respect to the whole polyols, wherein the amount of the crystalline polyol contained in the polyurethane prepolymer is 10% by mass or more and 80% by mass or less with respect to the whole polyols, wherein a ratio (NCO/OH) of the isocyanate group (NCO) to a hydroxyl group (OH) in the polyurethane prepolymer is more than 1.5 and 3.0 or less, and wherein a ratio (acryloyl group/isocyanate group) between the total amounts of (meth)acryloyl groups and the total amounts of isocyanate groups, which are respectively present at the end of a molecule of the polyurethane prepolymer, is from 0.1 to 0.6.

9. The method of manufacturing shoes according to claim 1, wherein one of said adherends is an outsole of a shoe.

10. The shoe of claim 8, wherein said constituent members include an outsole bonded to the shoe with said reactive hot-melt adhesive.

* * * * *